United States Patent [19]

Genfan

[11] Patent Number: 5,041,031

[45] Date of Patent: Aug. 20, 1991

[54] SWIMMING FRAME

[75] Inventor: German S. Genfan, 29 Keller Path, Newton, Mass. 02159

[73] Assignees: James T. Merchant, Worcester; German S. Genfan, Newton, both of Mass.

[21] Appl. No.: 505,171

[22] Filed: Apr. 5, 1990

[51] Int. Cl.[5] ..... B63H 16/08

[52] U.S. Cl. ..... 440/17; 440/21; 440/25

[58] Field of Search ..... 441/55; 440/13, 17, 440/21, 18–20, 25–31

[56] References Cited

FOREIGN PATENT DOCUMENTS 1013336 7/1952 France ..... 440/21

1103149 10/1955 France ..... 440/17

*Primary Examiner*—Sherman D. Basinger

[57] ABSTRACT

A swimming frame for competition in swimming, swimming instruction, muscle strengthening, and entertainment in the water comprises a pair of floats (1), a clamping unit (2, 3), and a paddle unit (4, 5, 6). It might be used by everyone regardless of the ability to swim. The paddle unit might by modified giving an additional possibility to practice butterfly-like and crawl-like style of swimming. A swimmer being clamped between rigid (2) and flexible (3) portion of the clamping unit is producing the push-pull movements of the paddle unit. When he pushes the unit, the paddle (4) is rotated up to horizontal position by the water pressure against its front. When he pulls the unit, the paddle is rotated up to vertical position by water pressure against its back. Because of the difference in the paddle hydroresistance between push and pull movements the swimming frame will be propelled by the swimmer.

5 Claims, 3 Drawing Sheets

SWIMMING FRAME

FIELD OF THE INVENTION

The invention herein presented relates to unpropelled swimming devices of the type having a paddle, side floats, and a clamping unit supporting a swimmer. It might be used both by adults and children for competition in swimming, including those that cannot swim, with equal possibility to win. Also it might be used for swimming instruction, muscle strengthening, and entertainment in the water.

BACKGROUND OF THE INVENTION

The conventional unpropelled swimming devices mostly are of the two types: a) the flipper-type, and b) the belt-type. The flipper-type devices might be used by those who can swim. It excludes a lot of people, especially children, out of swimming sporting events. The belt-type devices impart the swimmer with high hydroresistance. Because of this, those devices become uninteresting both for sport and entertainment. Besides, the belt-type devices impart swimmer's body almost vertical position. Such body position makes learning to swim a very difficult process. Also these devices do not contribute much to strengthening the swimmer's muscles. Further, the belt-type devices carry a comparatively large portion of the swimmer's body above the water surface. A large portion of the devices themselves are also above the water surface. This creates the possibility for the device to be propelled out control by high winds. This can be dangerous, especially for children.

It is desirable for the unpropelled swimming device to give everyone the possibility of having enjoyable competition and entertainment in the water independent from their ability to swim. It is also desirable for the device to give the swimmer a better muscle drill and to impart the beginning swimmer a body position that would be closest to horizontal. It is further desirable to have a device, especially for children, that is safe from the standpoint of air propulsion when wind blows.

SUMMARY OF THE INVENTION

The invention herein presented is a swimming frame comprised of a pair of floats, a clamping unit, and a paddle unit, said floats having an elongated tube-like shape and means for pivot connection with said clamping unit and slidable connection with said paddle unit, said clamping unit having a rigid bar-like portion with a means provided on each of its ends for said pivot connection with said floats and flexible belt-like portion for a swimmer to be safely secured to said rigid portion, said paddle unit having a paddle with a connecting rod and a pair of sliders each of which is interconnected with said float and secured to said connecting rod, said paddle having the means to provide different hydroresistance to said paddle when said paddle unit is moved by a swimmer in the water along said floats in two opposite directions, said connecting rod having room for a swimmer to grip by both hands during swimming, said pair of floats are positioned parallel to each other.

The paddle according to the present invention is hinged to the slider connecting rod. This hinge connection gives the paddle the ability to rotate 90 degrees. On the paddle side that is opposite to the hinge there is a weight. This weight always forces the paddle into the vertical position when in the water. The hinge gives the paddle the ability to rotate 90 degrees backward from vertical to horizontal position according to the swimming frame's direction of movement in the water.

To use the swimming frame a swimmer, being clamped in between flexible and rigid portions of the clamping unit, puts himself in a horizontal position in the water and moves the paddle unit backward and forward (pull-push movements). When pulled the weight and water pressure deviate the paddle into vertical position and its hydroresistance is at its highest. When pushed, the paddle deviates under the water pressure into horizontal position and its hydroresistance is at its lowest. Because of the difference in the paddle hydroresistance the swimming frame will be propelled by the swimmer.

Compared with traditional devices, the present invention gives every participant a good chance to win a swimming competition as well as enjoy themselves regardless of their ability to swim. It provides a good muscle drill, ideal body position for the beginning swimmer, and safety from air propulsion when wind blows. It provides safe usage both for children and adults.

DRAWINGS

DETAILED DESCRIPTION

Figure 1:
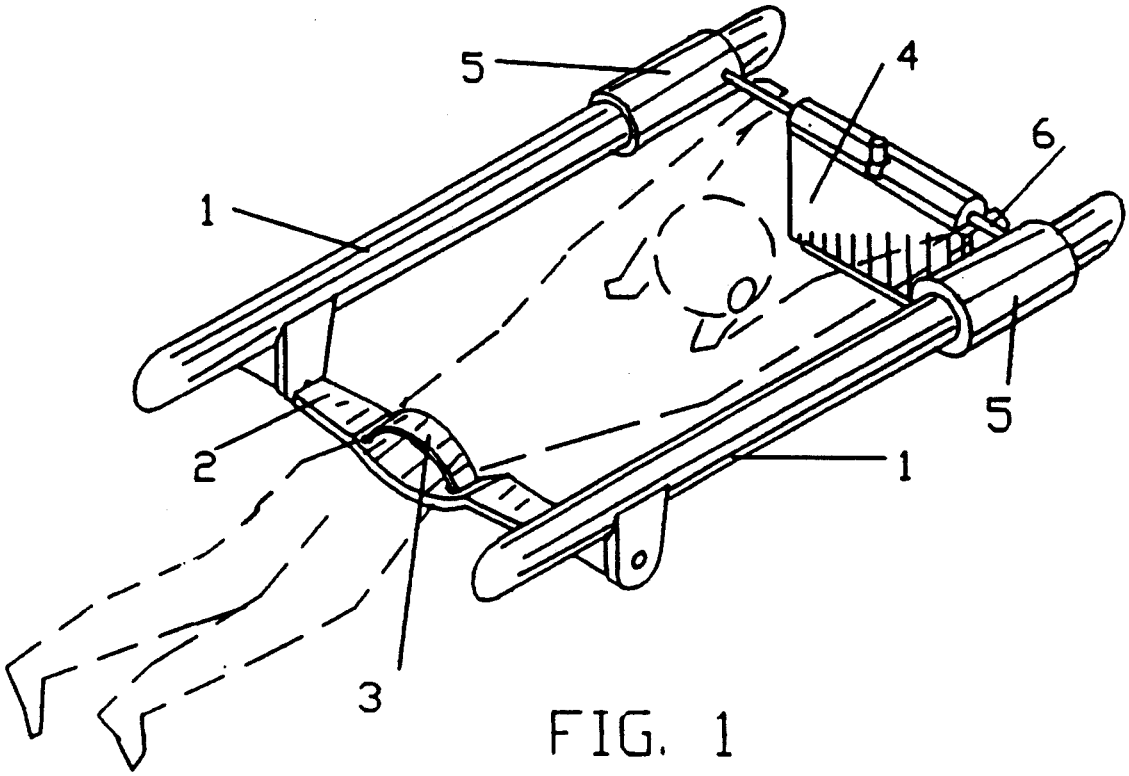
FIG. 1 is an isometric view of the swimming frame according to the present invention.
Figure 2:
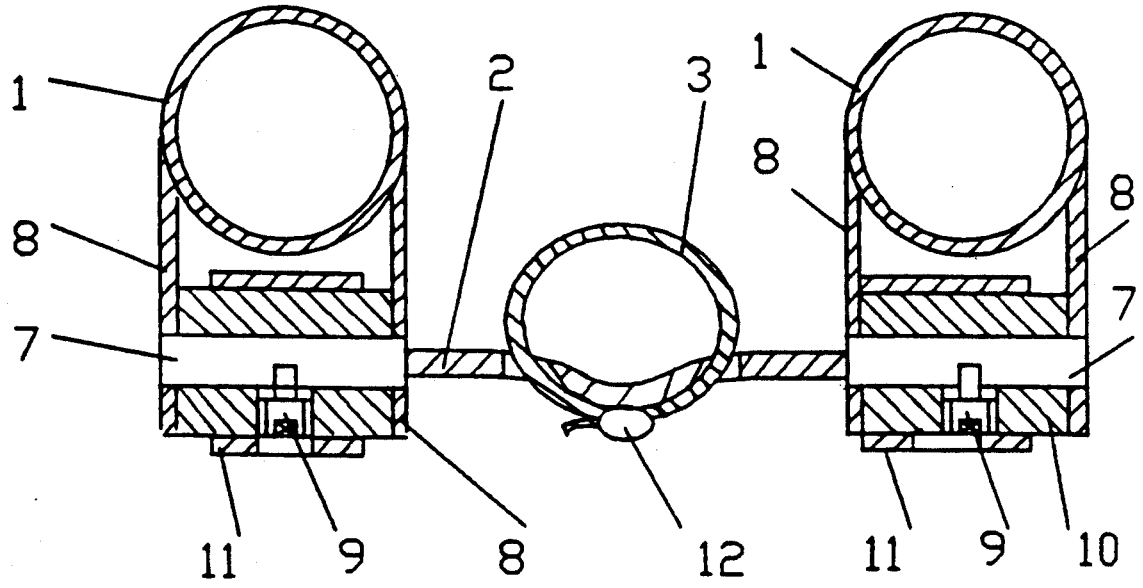
FIG. 2 is a cross sectional view of the clamping unit including floats and the pivot joints structure.

Referring to the drawings, FIG. 1 shows a swimming frame comprised of a pair of tube-like floats 1, a rigid clamp portion 2, a flexible clamp portion 3, and a paddle 4 with two sliders 5 secured to a connecting rod 6. The rigid clamp portion 2 has a shaft 7, secured to it on each side (FIG. 2). This shaft 7 may be rotated in bearing supports 8 composing a pivot joint between the rigid clamp portion 2 and the floats 1. Each shaft 7 is provided with a keyway that fits a locking screw 9 which in turn fits a tapped hole in the wall of a round bushing 10 interconnecting with the outside surface of the shaft 7. Each bushing 10 is inserted into a sleeve 11 that can be slided along and rotated around the bushing 10. The rigid clamp portion 2 has a pair of slots through which flexible clamp portion 3 can go. This flexible clamp portion 3 is provided with a buckle 12 for safely fastening a swimmer in the clamping unit in between its rigid portion 2 and its flexible portion 3.

Figure 3:
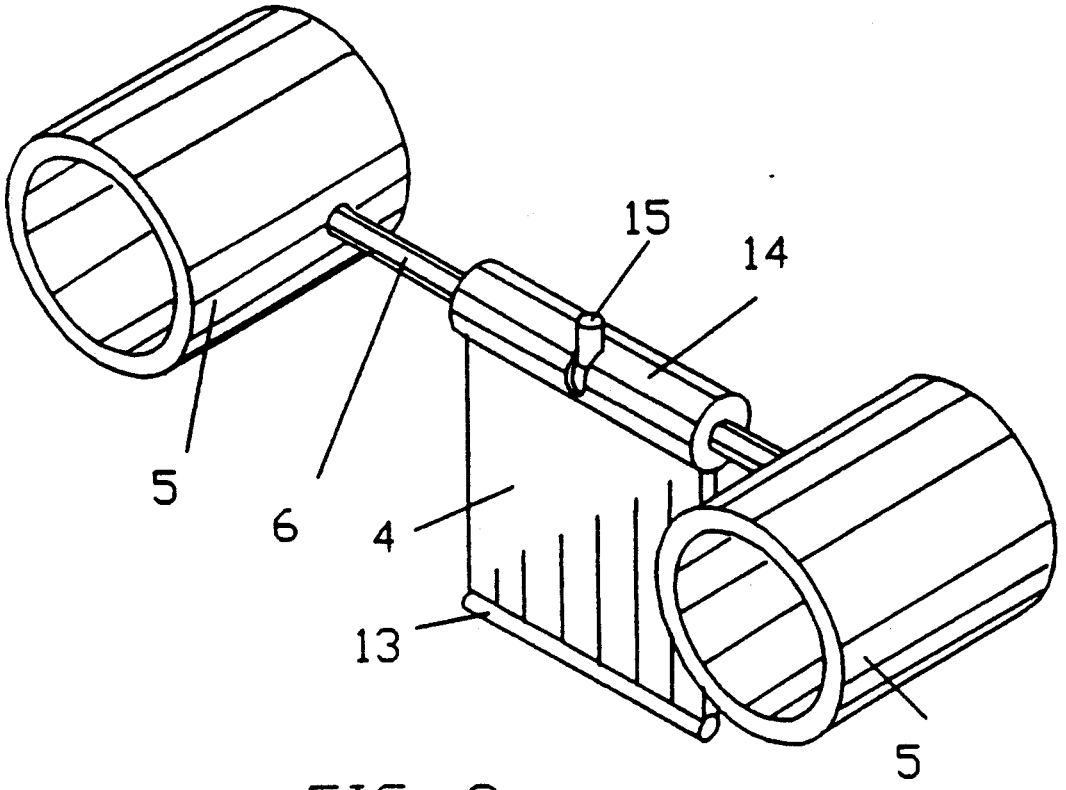
FIG. 3 is an isometric view of the paddle unit.

The paddle 4 (FIG. 3) is hinged to the connecting bar 6 by a hinge portion 14 formed on one of its sides and has a weight 13 on its opposite side. The connecting rod 6 is provided with a pin that is secured to this rod 6. In the hinge portion 14 of the paddle 4 there is a slot that fits the width of the pin 15. The length of the slot is equal to 90 degrees of an arc. The slot and pin give the paddle 4 the ability to be rotated backward when in the water from vertical position to horizontal position.

To use the swimming frame, a swimmer puts the flexible clamp portion 3 around his waist and inserts it into and through the slots in the rigid clamp portion 2 which the arranges against his stomach. During this process the front portion of the floats and the paddle unit will be rested on the ground (because of the pivot connection between the clamping unit and the floats). Therefore, most of the device's weight will not be carried by the swimmer during this set-up process. After the flexible clamp portion 3 is fastened by buckle 12 on the surface of the rigid clamp portion 2 (at the stomach area of the swimmer), the swimmer lifts up from the ground the front portion of the device by the connecting rod 6 and goes into the water. During this time, the weight of the device is supported by the body of the swimmer with only a fraction of the weight supported by his hands (the unbalanced weight). In the water the swimmer arranges himself and the swimming frame in the position shown on FIG. 1. Then the swimmer begins to produce the push-pull movements of the paddle unit. When he pushes the unit, the paddle 4 is rotated up to horizontal (or close to horizontal) position by the water pressure against its front. When he pulls the unit, the paddle 4 is rotated up to vertical position by water pressure against its back. The weight 13 and also the weight of the paddle 4 itself (if its material is heavier than water) will contribute to the rotation into vertical position.

Further rotation of the paddle 4 will be prevented by the pin 15 against the end of the slot in the hinge portion 14. From the moment on any further pull movement of the paddle unit will force the swimming frame (and swimmer) to move forward.

To steer the device, a swimmer should use his legs. For example, to turn the device to the right a swimmer should put down his right leg or bend it. The hydroresistance of the right side of the swimmer-device combination in this case will be increased and the right turn will be produced.

In order to make usage of the swimming frame more convenient, its construction should allow it to be quickly and reliably mounted and dismounted in field conditions. To dismount the device, one should rotate a sleeve 11 around and slide it along the bushing 10 until the hole in the wall of the sleeve 11 is aligned with the screw 9. Only after that can one unscrew the screw 9 and slide the float 1 out of the shaft 7. The probability that the hole in the sleeve 11 will be aligned with the screw 9 and the screw will be unscrewed by itself during swimming is negligible.

The paddle unit might be dismounted simply by being slid out of the floats 1. Thus, the whole device when dismounted consists of four elongated pieces: a pair of floats, a paddle unit, and a clamping unit. All those pieces can be easily packed and transported.

Figure 4:
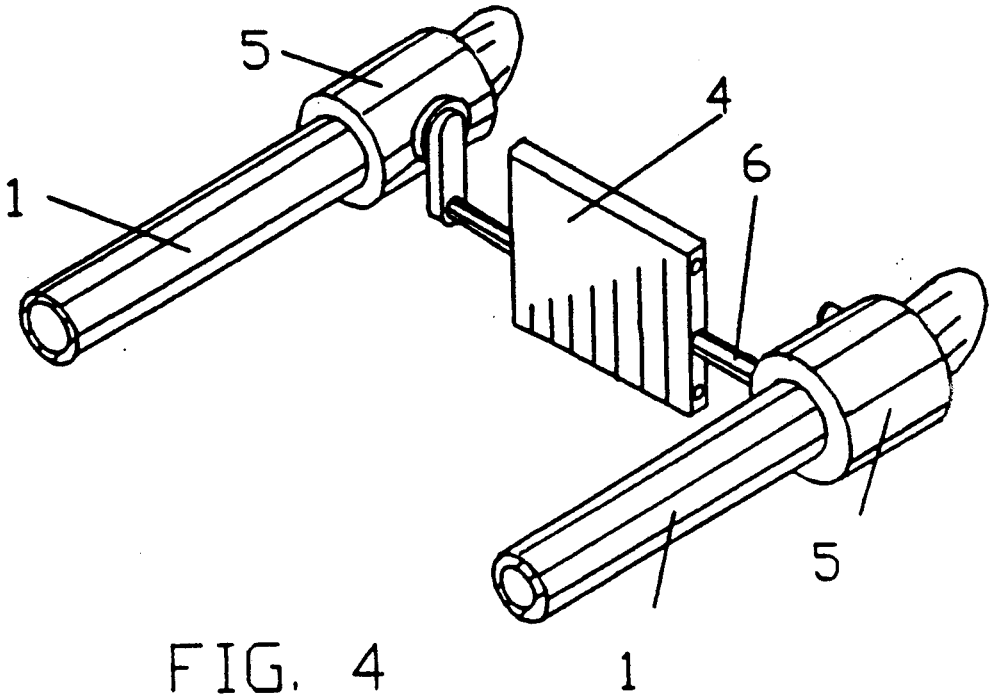
FIG. 4 is an isometric view of the front portion of the swimming frame with optional paddle unit for butterfly-like style of swimming.
Figure 5:
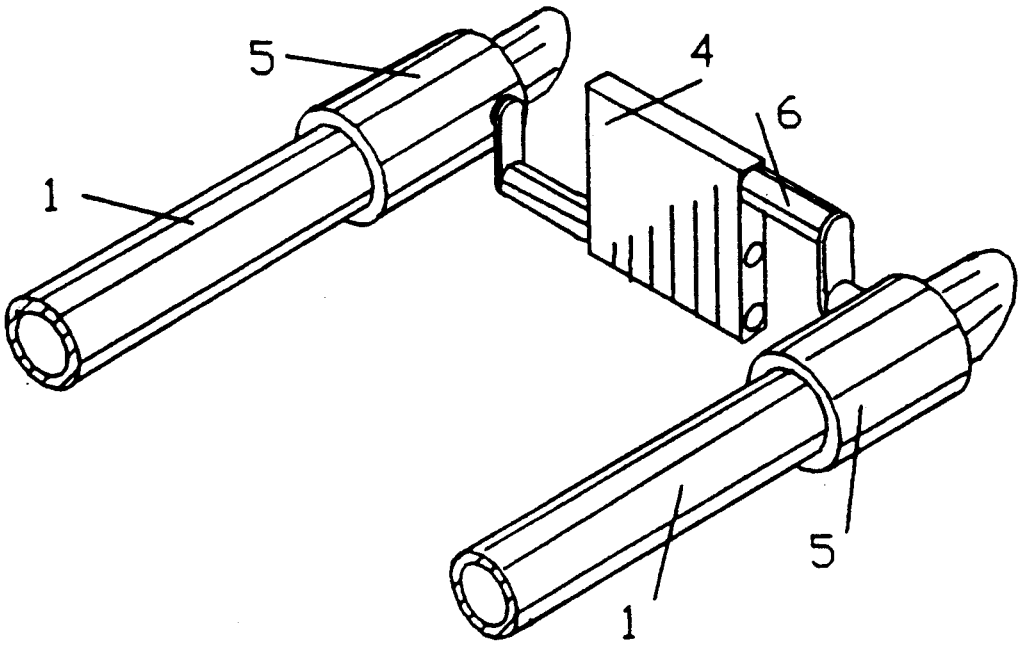
FIG. 5 is an isometric view of the front portion of the swimming frame with optional paddle unit for crawl-like style of swimming.

It has to be understood that the general idea of the invention herein described, and the implementation might be modified in different ways. For example, the paddle unit might be modified in such a way that it will provide the possibility of practicing different styles of swimming. The modification for a butterfly-like style of swimming is shown on FIG. 4. The modification for a crawl-like style is shown on FIG. 5. For both of the modifications, the connecting rod 6 can be rotated in the sliders 5 and should be made like crank-shaft. In the modification shown on FIG. 4 the paddle 4 is secured to the connecting rod on its center line. A swimmer rotates the paddle 4, which is totally in the water when in its lowest position, or totally outside the water when in its highest position. In the modification shown on FIG. 5 the paddle 4 is secured to the connecting rod 6 by its two diagonally opposite corners and its center line is aligned with the axis of the connecting rod 6 rotation. In this case half of the paddle 4 will be in the water and the second half will be above the water surface. Thus, the swimming frame is simple, reliable, convenient to use, and provides a variety of applications.

I claim:

1. A swimming frame, comprising a pair of floats, a clamping unit, and a paddle unit, said floats having elongated tube-like shape and means for pivot connection with said clamping unit and a slidable connection with said paddle unit, said clamping unit having a rigid bar-like portion with a means provided on each of its ends for said pivot connection with said floats and a flexible belt-like portion for a swimmer to be safely secured to said rigid portion, said paddle unit having a paddle with a connecting rod and a pair of sliders each of which is interconnected with said float and secured to said connecting rod, said paddle having means to provide different hydroresistance to said paddle when said paddle unit is moved by a swimmer in the water along said floats in opposite directions, said connecting rod having room for a swimmer to grip it by both hands during swimming, said pair of floats being positioned parallel to each other, said floats each having a longitudinal axis, said clamping unit pivoting through said means for pivot connection about an axis, said axis being substantially perpendicular to said longitudinal axis of each said float, said floats having a front portion and a rear portion, said sliders of said paddle unit being interconnected with said floats along said front portion, and said clamping unit being pivotally connected with said floats rearwardly of said paddle unit and toward said rear portion.

2. A swimming frame according to claim 1 wherein said paddle and said connecting rod have a hinge connecting each other, said hinge connection is comprised of a tube-like portion formed on said paddle, said connecting rod being positioned inside said tube-like portion, said tube-like portion having a slot of 90 degrees of an arc, said connecting rod having a pin secured to said rod and interconnecting with said slot, said paddle having a weight on the side opposite to said hinge.

3. A swimming frame according to claim 1 wherein said rigid portion of the clamping unit has a pair of slots through which said flexible portion of the unit can be buckled by a swimmer on his stomach against said rigid portion and each end of said rigid portion having a shaft secured to it which is provided with a keyway.

4. A swimming frame according to claim 3 wherein said pair of floats each having a pair of bearing supports secured to said float and a bushing secured to said bearing support to receive said shaft, said bushing having in its wall a tapped hole to receive a screw and also having a sleeve on its outside surface that might be rotated around and slid along said bushing, said sleeve having a hole for said screw to go through when said swimming frame is mounted or dismounted, an end of said screw can go into said keyway, and said floats having appropriate shapes and dimensions to accommodate said sliders.

5. A swimming frame for both sporting events and entertainment, comprising:

(a) a pair of parallel positioned floats with bearing supports to receive shafts and outside surfaces to accommodate sliders, (b) a clamping unit in which a rigid portion with shafts secured to each of its ends has a pair of slots through which can go a flexible belt-like portion having a buckle, (c) a paddle unit with a pair of parallel positioned sliders secured to each end of a connecting rod on which there is a pin positioned in a slot located in a hinged portion of a paddle through which the connecting rod goes.

(d) said floats comprised of said bearing supports with a bushing in each of them to receive one of the shafts of the clamping unit and secure it by a screw in a tapped hole in the wall of the bushing, and a sleeve with a hole provided in its wall that can be slid along and rotated around the bushing to align the hole with the screw when one needs to mount or dismount the swimming frame.

(e) said slot length being 90 degrees of an arc, (f) said paddle having a weight on the side that is opposite to the hinge, and (g) said shaft having a keyway to receive the end of said screw.

* * * * *